US007382325B1

(12) United States Patent
Chao et al.

(10) Patent No.: US 7,382,325 B1
(45) Date of Patent: Jun. 3, 2008

(54) MICRO STACKED TYPE CHIP ANTENNA

(75) Inventors: Yu-Shu Chao, Pa-Te (TW); Chi-Ming Chiang, Pa-Te (TW); Pai-Cheng Huang, Pa-Te (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 0 days.

(21) Appl. No.: 11/559,424

(22) Filed: Nov. 14, 2006

(51) Int. Cl.
*H01Q 1/24* (2006.01)

(52) U.S. Cl. ..... 343/702; 343/702; 343/700 MS; 343/873

(58) Field of Classification Search ..... 343/700 MS, 343/702, 873
See application file for complete search history.

(56) References Cited

U.S. PATENT DOCUMENTS 5,870,066 A * 2/1999 Asakura et al. ..... 343/895
2002/0075186 A1* 6/2002 Hamada et al. ..... 343/700 MS
2004/0119647 A1* 6/2004 Harihara ..... 343/700 MS
2007/0001925 A1* 1/2007 Bae et al. ..... 343/895

* cited by examiner

*Primary Examiner*—Trnh V. Dinh
*Assistant Examiner*—Dieu Hien T Duong
(74) *Attorney, Agent, or Firm*—Ming Chow; Sinorica, LLC

(57) ABSTRACT

A micro stacked type chip antenna, wherein a plurality of elementary layers printed with radiation metallic electrodes are stacked up to allow the radiation metallic electrodes on the elementary layers to electrically connect each with its neighboring ones (one) of the radiation metallic electrodes on its upper one and/or lower one of the elementary layers; and then these elementary layers stacked up are packed in a packing process, a plurality of connecting pins are connected respectively with the radiation metallic electrodes on different elementary layers, the tailing end of each connecting pin is extended out of a packing envelop; by various options of connecting of the connecting pins, resonant frequencies of different band widths can be obtained.

7 Claims, 3 Drawing Sheets

MICRO STACKED TYPE CHIP ANTENNA

BACKGROUND OF THE INVENTION

1. Field of the Invention

The present invention relates to a micro stacked type chip antenna, and especially to a micro stacked type chip antenna having multiple elementary layers being stacked and packed, the micro stacked type chip antenna can provide various options for getting a suitable band width as required.

2. Description of the Prior Art

Wireless communication has been being well developed nowadays, the range of using of radio frequencies becomes more and more extended; for instance, communication frequencies for satellite communication, wireless network, digital televisions, mobile phones etc. are different from one another. The conventional way is to design an antenna of a resonant frequency for a kind of frequency demand; thereby, there have been being a variant development, and various patent designs.

An advanced micro stacked type chip antenna used presently has a radiation metallic electrode packed in dielectric material, such as ceramic material, in order that the antenna can be integrated with a semiconductor die or chip having an electronic system to achieve an object of miniaturization.

Since developing of chip antennas, now there are chip antennas with the function of operating on two frequencies; however after all, such chip antennas are limited to the range of use of very small band widths; they are unable to meet the requirements of all kinds of frequencies.

Some kind of monopole antenna is provided with a plurality of component sheets stacked from bottom to top, wherein a gap for adjusting impedance matching is provided between every two component sheets, and the component sheets form centrally thereof an integral connecting neck, a feed-in line is provided on the bottom of the antenna; the component sheets get their desired broad bandwidth by adjusting the height stacked by the component sheets. The antenna obtained from such an idea is suitable for many kinds of frequencies covering the CMDA (code vision multiple access) system (824-894 MHZ), the Pan Europe mobile phone system (GSM, 880-960 MHZ), the digital communication system (DSC, 1710-1880 MHZ), the personal communication system ( PCS, 1850-1990 MHZ), the personal mobile phone system (PHS, 1905-1920 MHZ) and the broadband code vision multiple access system (WCDMA, 2010-2025 MHZ).

By virtue that such an antenna can have the desired broad bandwidth for use adjusted according to the stacked height of the component sheets, the main motive of the present invention thus is resided in a question whether a micro antenna can be provided to be more suitable for various ranges of frequency.

SUMMARY OF THE INVENTION

The present invention thereby provides a micro stacked type chip antenna, wherein a plurality of elementary layers printed with radiation metallic electrodes are stacked up to allow these radiation metallic electrodes on the elementary layers to electrically connect each with its neighboring ones (one) of the radiation metallic electrodes on its upper one and/or lower one of the elementary layers; and then these elementary layers stacked up are packed in a packing process, a plurality of connecting pins are connected respectively with the radiation metallic electrodes on different elementary layers, the tailing ends of the connecting pins are extended out of a packing envelop; by various options of connecting of the connecting pins, resonant frequencies of different band widths can be obtained.

The present invention is designed presently for 10 elementary layers, but a range of frequency within 134 MHz~6GHz can be obtained just by using more than 8 elementary layers. When in connecting to an electric circuit board of a set of electronic equipment, a user needs only to choose appropriate pins of a chip antenna according to the band widths required by the electronic equipment. In this view, the present invention has more practical humanized designing.

The elementary layers in the present invention can be of the material for a printed circuit board, or of ceramic material. The material for packing can be one that allows easy micro adjusting the dielectric coefficient of the material, such as compound of resin and ceramic material etc.

The present invention will be apparent in its manufacturing, structure and effects of use after reading the detailed description of the preferred embodiment thereof in reference to the accompanying drawings.

DETAILED DESCRIPTION OF THE PREFERRED EMBODIMENT

Figure 1:
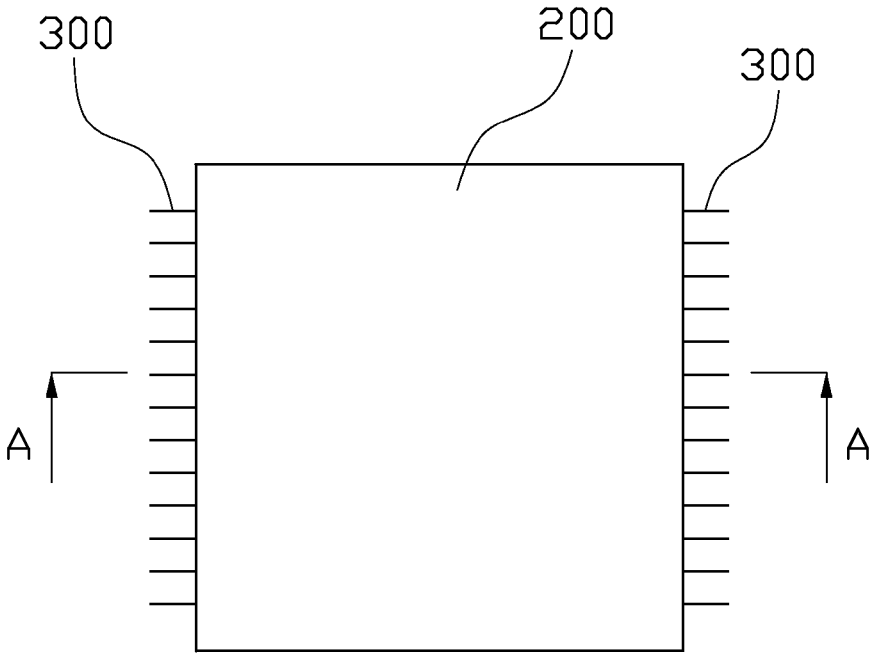
FIG. 1 is a plane view of a micro stacked type chip antenna of the present invention.
Figure 2:
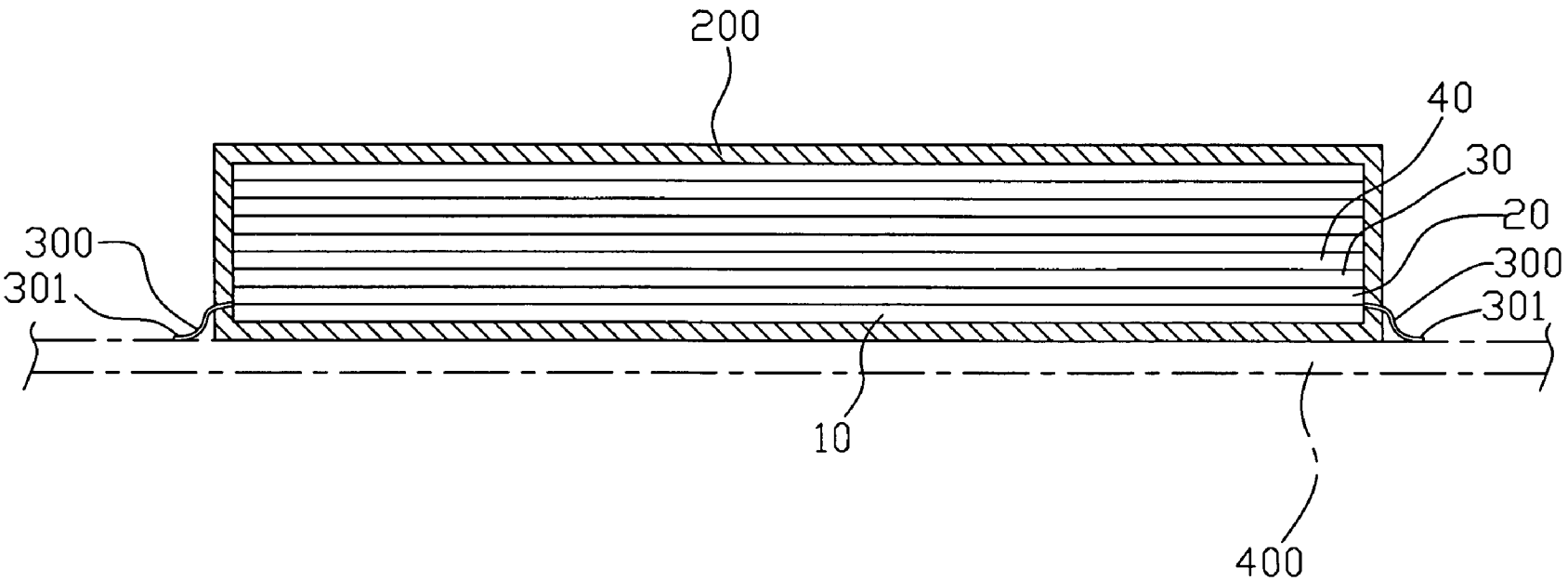
FIG. 2 is a sectional view taken from line A-A of FIG. 1 of the present invention.
Figure 3:
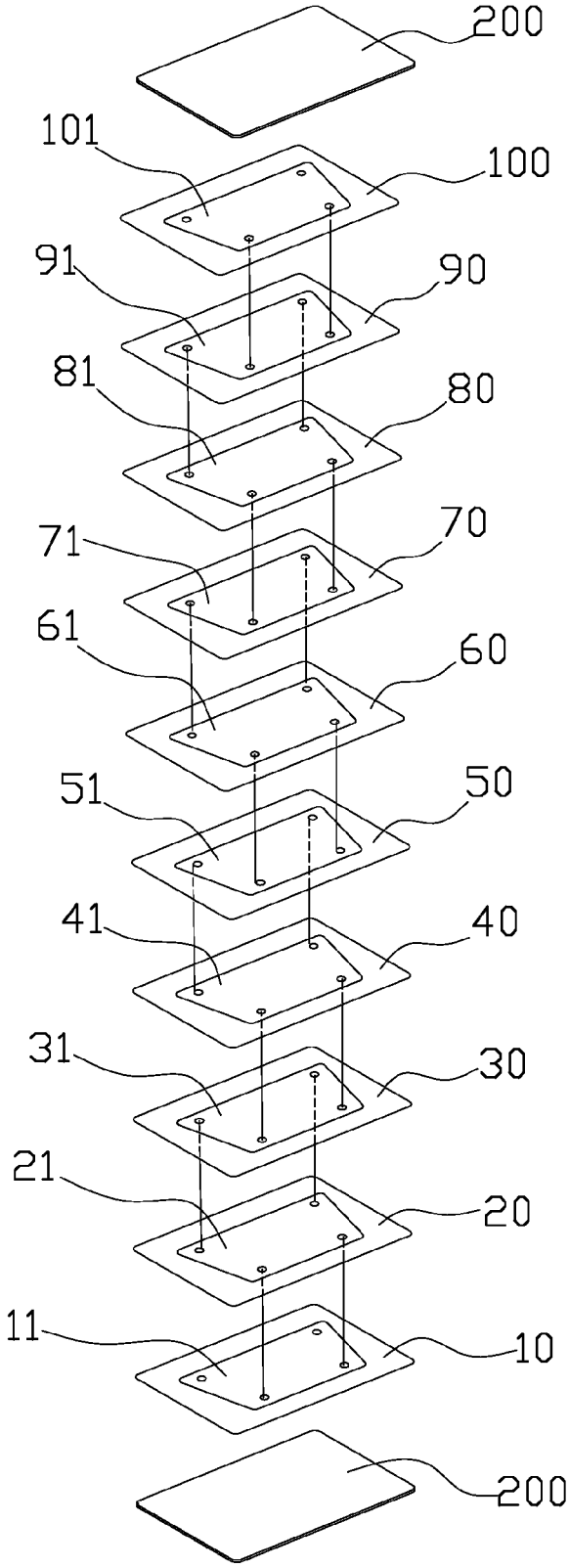
FIG. 3 is an anatomic perspective view of multiple elementary layers of the present invention.

Referring to FIGS. 1-3, a micro stacked type chip antenna of the present invention has multiple stacked and packed elementary layers 10, 20, 30 . . . and 100, it is packed with a packing envelop 200, multiple connecting pins 300 are extended out of the packing envelop 200. "The stacked elementary layers 10, 20, 30 . . . and 100 at least contains more than 8 layers, the elementary layers 10~100 each has on its surface a printed radiation metallic electrode 11, 21, 31 . . . or 101; these radiation metallic electrodes 11~101 are electrically connected each with its neighboring ones (one) of the radiation metallic electrodes on its upper one and/or lower one of the elementary layers; FIG. 3 shows such connection with straight lines. The multiple connecting pins 300 are connected correspondingly with the radiation metallic electrodes 11~101, the tailing end 301 of each connecting pin 300 is extended out of the packing envelop 200 to connect with an electric circuit board 400 of a set of electronic equipment of FIG. 2."

When the present invention is mounted on an electric circuit board of the electronic equipment, by various options of connecting of the connecting pins, resonant frequencies of different band widths can be obtained. Thereby the same chip antenna can suit various products. In this way, a manufacturer will no more need to design an antenna only for a using range of frequency; rather, the chip antenna of the present invention can suit various kinds of electronic equipment. And the present invention can render its cost of mass production to be much reduced by a manufacturing process like that for integrated circuits.

In manufacturing the present invention, the elementary layers 10~100 having on their surfaces multiple printed radiation metallic electrodes 11~101 are stacked up, these radiation metallic electrodes 11~101 are electrically connected each with the radiation metallic electrodes (electrode) on the its upper and/or lower elementary layers; then the elementary layers 10~100 are packed in a packing process to form the packing envelop 200, and the connecting pins 300 are connected correspondingly with the radiation metallic electrodes 11~101, the tailing end of each connecting pin 300 is extended out of the packing envelop 200.

A range of frequency within 134 MHz~6GHz can be obtained presently by using more than 8 elementary layers.

The elementary layers 10~100 can be printed circuit boards, manufacturing can be started from the most bottom elementary layer 10; then the radiation metallic electrode 11 is formed by etching on the printed circuit board of the elementary layer 10, and then a patch is formed on thereon. After that, the next elementary layer 20 is manufactured, and so on, and so on, manufacturing of the stacked elementary layers 10, 20, 30 . . . and 100 thus is completed.

The material for the stacked elementary layers 10, 20, 30 . . . and 100 can be ceramic material.

After completion of manufacturing the stacked elementary layers 10, 20, 30 . . . and 100, the packing envelop 200 is made by embedded injection molding or casting molding; then the process of manufacturing the micro stacked type chip antenna of the present invention is completed.

The stacked elementary layers 10, 20, 30 . . . and 100 of the present invention can be applied to manufacturing a System of Chip (SoC).

The preferred embodiment disclosed above is only for illustrating the present invention. It will be apparent to those skilled in this art that various modifications or changes made to the elements of the present invention without departing from the spirit of this invention fall within the scope of the appended claims and are intended to form part of this invention.

The invention claimed is:

1. A micro stacked type chip antenna comprising:

at least 8 stacked up elementary layers each printed with a radiation metallic electrode, said radiation metallic electrodes are electrically connected each with its neighboring ones (one) of said radiation metallic electrodes on its upper one and/or lower one of said elementary layers;

a packing envelop enveloping said stacked up elementary layers;

a plurality of connecting pins connected respectively with said radiation metallic electrodes, a tailing end of each of said connecting pins is extended out of said packing envelop to connect an electric circuit board of a set of electronic equipment;

by various options of connecting of said connecting pins, resonant frequencies of different band widths are obtained.

2. The micro stacked type chip antenna as defined in claim 1, wherein said resonant frequencies are in a range within 134 MHz~6GHz.

3. The micro stacked type chip antenna as defined in claim 1, wherein said elementary layers are printed circuit boards.

4. The micro stacked type chip antenna as defined in claim 1, wherein said elementary layers are made of ceramic material.

5. The micro stacked type chip antenna as defined in claim 1, wherein said packing envelop is made by a packing process of embedded injection.

6. The micro stacked type chip antenna as defined in claim 1, wherein said packing envelop is made by a packing process of casting molding.

7. The micro stacked type chip antenna as defined in claim 1, wherein said stacked type chip antenna is applied to manufacturing a System of Chip (SoC).

* * * * *